US010940924B2

(12) United States Patent
Adachi

(10) Patent No.: US 10,940,924 B2
(45) Date of Patent: Mar. 9, 2021

(54) ALERT CONTROL SYSTEM USING MODE OF SHIP, ALERT CONTROL METHOD USING MODE OF SHIP, AND RECORDING MEDIUM STORING ALERT CONTROL PROGRAM USING MODE OF SHIP

(71) Applicant: FUJITSU LIMITED, Kawasaki (JP)

(72) Inventor: Takayuki Adachi, Ebetsu (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 16/056,854

(22) Filed: Aug. 7, 2018

(65) Prior Publication Data

US 2018/0339753 A1 Nov. 29, 2018

Related U.S. Application Data

(63) Continuation of application No. PCT/JP2016/054033, filed on Feb. 10, 2016.

(51) Int. Cl.

| | |
|---|---|
| ***B63B 45/00*** | (2006.01) |
| ***B63B 45/04*** | (2006.01) |
| ***B63B 43/18*** | (2006.01) |
| ***B63B 21/00*** | (2006.01) |

(52) U.S. Cl.

CPC ..... *B63B 45/00* (2013.01); *B63B 21/00* (2013.01); *B63B 43/18* (2013.01); *B63B 45/04* (2013.01); *B63B 2021/009* (2013.01)

(58) Field of Classification Search

CPC ..... B63B 45/00; B63B 21/00; B63B 43/18; B63B 45/04; B63B 2021/009; B63B 2021/007

See application file for complete search history.

(56) References Cited

U.S. PATENT DOCUMENTS 2,507,986 A * 5/1950 Russel ..... G01C 13/008 200/61.44
3,579,182 A * 5/1971 Schneider ..... H01H 35/02 340/986
5,251,185 A * 10/1993 Baggenstoss ..... G01S 7/527 367/100
5,261,344 A * 11/1993 Pickett ..... B63G 9/00 114/221 A
5,932,815 A * 8/1999 Dodds ..... B63B 21/00 340/531

(Continued)

FOREIGN PATENT DOCUMENTS

JP 61-112982 5/1986
JP 2002-288800 10/2002

(Continued)

OTHER PUBLICATIONS

International Search Report dated Apr. 16, 2016 in corresponding International Patent Application No. PCT/JP2016/054033.

*Primary Examiner* — Rufus C Point
(74) *Attorney, Agent, or Firm* — Staas & Halsey LLP

(57) ABSTRACT

An alert control system includes a memory, and a processor coupled to the memory, wherein the processor is configured to: receive a first input of an anchorage instruction or a second input indicating an anchorage state, and perform, in accordance with the first input or the second input, control to reduce a number of kinds of triggers which output an alert.

20 Claims, 10 Drawing Sheets

(56) References Cited

U.S. PATENT DOCUMENTS 6,472,983 B1* 10/2002 Grunder ..... B63B 21/00 340/531
6,804,607 B1* 10/2004 Wood ..... G01S 17/86 701/301
6,970,578 B1* 11/2005 Strand ..... G06K 9/00637 348/81
2002/0086594 A1* 7/2002 Colyvas ..... B63H 20/12 440/63
2003/0128138 A1* 7/2003 Grunder ..... B63B 21/00 340/986
2003/0220724 A1* 11/2003 Kaji ..... G05D 1/0206 701/21
2005/0252433 A1* 11/2005 Gai ..... B63H 25/02 114/144 R
2008/0191902 A1 8/2008 Kolb
2008/0251000 A1* 10/2008 Blakesley ..... B63B 21/24 114/293
2012/0191335 A1 7/2012 Kita et al.
2012/0274504 A1* 11/2012 Kubota ..... G01S 7/22 342/179
2014/0180566 A1* 6/2014 Malhotra ..... G08G 3/02 701/300
2014/0365390 A1* 12/2014 Braun ..... G16H 40/20 705/325
2015/0116496 A1* 4/2015 Ottaviano ..... B63B 21/26 348/148
2016/0223659 A1* 8/2016 Mandelert ..... B63G 7/08
2017/0057603 A1* 3/2017 Shumate ..... B63B 45/00
2017/0253308 A1* 9/2017 Morita ..... G01C 21/203
2018/0118312 A1* 5/2018 Mishima ..... B63B 49/00
2018/0339753 A1* 11/2018 Adachi ..... B63B 21/00

FOREIGN PATENT DOCUMENTS

JP 2005-140546 6/2005
JP 2008-198214 8/2008
JP 2012-22446 2/2012
JP 2012-155359 8/2012
JP 2015-164006 9/2015

* cited by examiner

FIG. 3

13c

| MARINA ID | PORT DEPARTURE ID | SHIP ID | PORT DEPARTURE SCHEDULED DATE AND TIME | PORT ARRIVAL SCHEDULED DATE AND TIME | PORT DEPARTURE DATE AND TIME | PORT ARRIVAL DATE AND TIME | CURRENT POSITION | PORT DEPARTURE AND ARRIVAL STATUS | ALERT STATE |
|---|---|---|---|---|---|---|---|---|---|
| M001 | 01 | JP-ABC12345D404 | 2016/3/1 9:00 | 2016/3/1 15:00 | 2016/3/1 9:00 | 2016/3/1 14:30 | - | ARRIVED | - |
| M001 | 02 | JP-DEF54321N505 | 2016/3/1 9:30 | 2016/3/1 16:00 | 2016/3/1 10:00 | - | 35.632454, 139.853074 | DEPARTED | ANCHOR DRAGGING |
| M001 | 03 | JP-HIJ56789J123 | 2016/3/1 10:00 | 2016/3/1 16:00 | 2016/3/1 10:15 | - | 35.632460, 139.853080 | DEPARTED | (ANCHORED) |
| M001 | 04 | JP-HIJ98765J200 | 2016/3/1 10:00 | 2016/3/1 15:30 | 2016/3/1 9:45 | - | 35.632465, 139.853085 | DEPARTED | SHOAL WARNING |
| ... | ... | ... | ... | ... | ... | ... | ... | ... | ... |

ALERT CONTROL SYSTEM USING MODE OF SHIP, ALERT CONTROL METHOD USING MODE OF SHIP, AND RECORDING MEDIUM STORING ALERT CONTROL PROGRAM USING MODE OF SHIP

CROSS-REFERENCE TO RELATED APPLICATION

This application is a continuation application of International Application PCT/JP2016/054033 filed on Feb. 10, 2016 and designated the U.S., the entire contents of which are incorporated herein by reference.

FIELD

The embodiments discussed herein are related to an alert control system, an alert control method, and a recording medium storing an alert control program.

BACKGROUND

Technologies of outputting an alert related to a ship include an anchoring monitoring system and a method of improving traffic safety of transportation.

Related technologies disclosed in Japanese Laid-open Patent Publication Nos. 2005-140549 and 2008-198214.

SUMMARY

According to an aspect of the embodiments, an alert control system includes a memory, and a processor coupled to the memory, wherein the processor is configured to: receive a first input of an anchorage instruction or a second input indicating an anchorage state, and perform, in accordance with the first input or the second input, control to reduce a number of kinds of triggers which output an alert.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 3 is a diagram illustrating exemplary navigation data;

DESCRIPTION OF EMBODIMENTS

For example, the linear distance between an anchorage position and the current ship position is calculated based on the D-GPS latitudes and longitudes of an anchorage position acquired by a D-GPS receiver and the current ship position. When it is determined that the linear distance exceeds an alert set distance, an alert that anchor dragging is occurring or potentially occurs is set off.

For example, methods of improving traffic safety of transportation may be also applied to ship navigation as well. The actual position and direction of a ship are constantly determined. The actual position and direction of the ship are displayed on a marine chart on a display. The marine chart indicates the shapes of coast lines, restricted areas, obstacles, and shoals. Additionally, a system determines the current draft of the ship depending on the load of the ship. When the ship is approaching to a place determined to be at risk of marine accident due to the current draft and the current external conditions such as tide, the height of wave, and wind, appropriate warning is automatically output by sound, as a text instruction on the display, and marking of a dangerous place on the marine chart.

For example, an alert is set off when anchor dragging has occurred, and a warning is output when the ship is approaching to a place at risk of marine accident.

However, the kinds of warnings useful to be notified to a ship operator are not necessarily identical in mooring after anchorage and normal operation.

For example, when anchored in mooring, the ship is less likely to approach to a place at risk of marine accident than when the ship is under navigation. A warning in this situation is an unnecessary alert output to the ship operator.

As described above, the kinds of warnings useful to be notified to the ship operator are different in mooring after anchorage and normal operation.

It is preferable to provide, for example, an alert control computer system capable of reducing outputting of alerts unnecessary for the ship operator.

The following describes embodiments of an alert control computer system, an alert control method, and an alert control program according to the present application with reference to the accompanying drawings. The embodiments do not limit the disclosed technology. The embodiments may be combined as appropriate while the contents of processing are maintained consistent.

Embodiment 1

[System Configuration]

Figure 1:
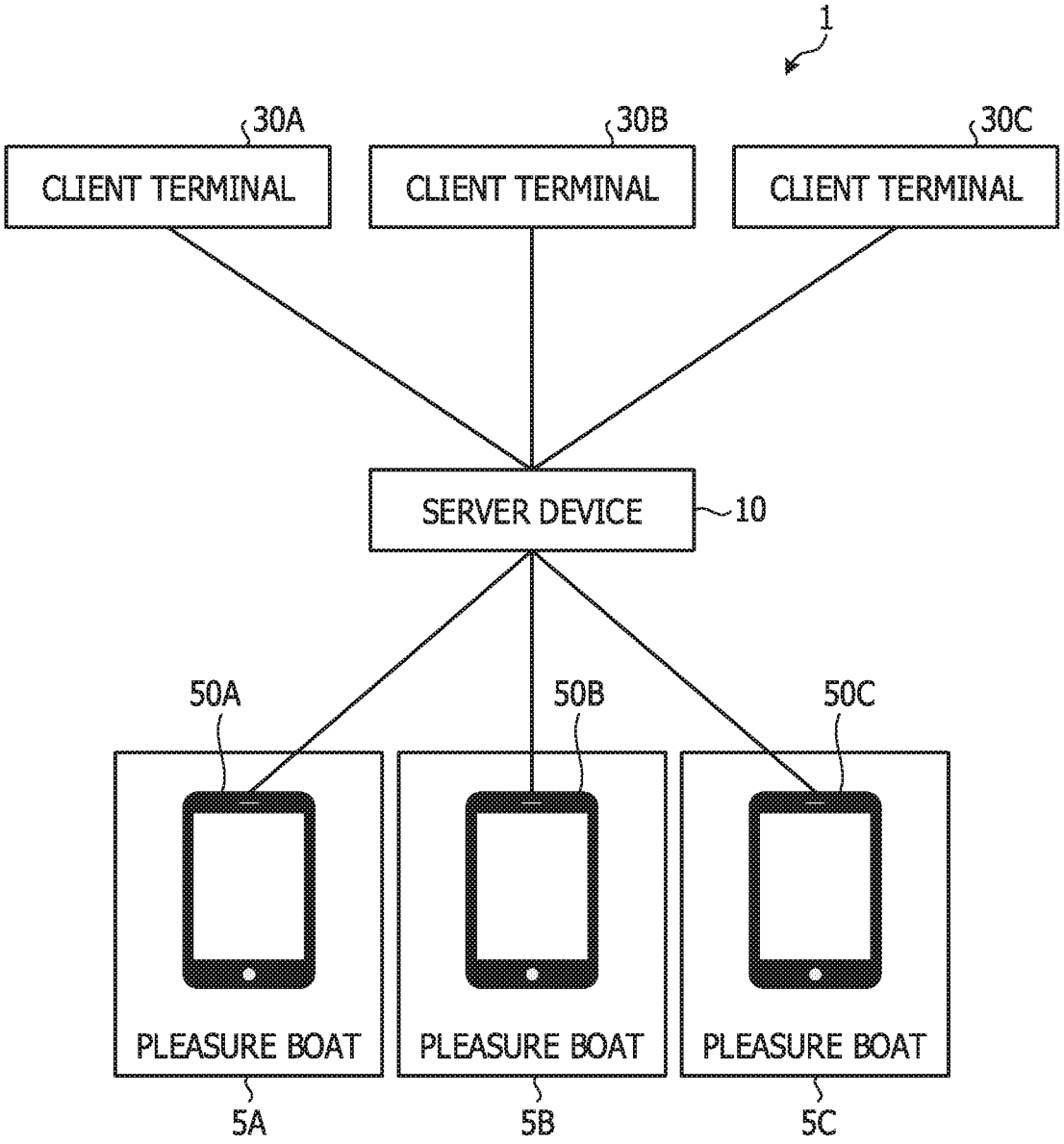
FIG. 1 is a diagram illustrating an exemplary configuration of a navigation management support system according to Embodiment 1.

FIG. 1 is a diagram illustrating an exemplary configuration of a navigation management support system according to Embodiment 1. In this navigation management support system 1 illustrated in FIG. 1, a user is a marina as a business operator who manages a port and provides navigation management service that manages operation of any ship belonging to the port. In the navigation management support system 1 illustrated in FIG. 1, an end user is a crew member of each ship belonging to the port, and the system provides the end user with navigation support service that supports safety navigation.

The navigation management service and the navigation support service are applicable to a ship of any classification, particularly to a small-sized ship, which makes the services further useful. Installation of a marine instrument such as an automatic identification system (AIS) is requested for large-sized ships, but not for small-sized ships. This situation makes it more difficult to provide navigation management and navigation support of small-sized ships, particularly, ships used in marine leisure, which are called pleasure boats (5A to 5C) than those of large-sized ships.

Thus, the navigation management support system 1 utilizes, for the navigation management service and the navigation support service, functions of portable terminal devices 50A to 50C owned by crew members of the pleasure boats 5A to 5C, for example, ship operators thereof. Hereinafter, when collectively referred, the pleasure boats 5A to 5C are also referred to as a "pleasure boat 5".

The following exemplarily describes a case in which the navigation management service and the navigation support service are provided to the pleasure boat 5, but the navigation management service and the navigation support service may be provided to any other small-sized ship such as a fishing boat. In addition, the navigation management service and the navigation support service may be provided to any large-sized ship by exploiting the existing technology such as a marine instrument.

As illustrated in FIG. 1, the navigation management support system 1 includes a server device 10, client terminals 30A to 30C, and the portable terminal devices 50A to 50C. Hereinafter, when collectively referred, the client terminals 30A to 30C are also referred to as a "client terminal 30". When collectively referred, the portable terminal devices 50A to 50C are also referred to as a "portable terminal device 50". Although FIG. 1 exemplarily illustrates a configuration in which the server device 10 houses the three client terminals 30 and the three portable terminal devices 50, the present disclosure is not limited to the illustrated example. The server device 10 may house an optional number of client terminals 30 and an optional number of portable terminal devices 50.

The server device 10 is a computer configured to provide the navigation management service to the client terminal 30.

According to an embodiment, the server device 10 may be implemented by installing, to a desired computer, a navigation management program configured to achieve the navigation management service as package software or online software. For example, the server device 10 may be implemented as a Web server configured to provide the navigation management service or may be implemented as a cloud configured to provide the navigation management service by outsourcing.

The client terminal 30 is a computer configured to receive provision of the navigation management service from the server device 10. The client terminal 30 may be used by, for example, any person concerned with the marina such as a staff or manager of the marina.

According to the embodiment, the client terminal 30 may be achieved by a personal computer. The client terminal 30 is not limited to a stationary information processing device such as a personal computer as described above, but may be various portable terminal devices that the marina lends to a person concerned therewith. Examples of the "portable terminal devices" include mobile communication terminals such as a smartphone, a cellular phone, and a personal handyphone system (PHS) phone, a slate terminal, and a tablet terminal.

For example, the client terminal 30 receives request for login to the server device 10 by receiving inputting of account information allocated to the marina, for example, an identification (ID) and a password. When this login request is transmitted from the client terminal 30 to the server device 10, the server device 10 executes login authentication. When the login authentication is successful, the navigation management service related to the marina is released to the client terminal 30 having succeeded the login authentication.

The server device 10 and the client terminal 30 are connected with each other through a predetermined network. Examples of such a network include optional kinds of wired and wireless communication networks such as the Internet, a LAN, and a virtual private network (VPN).

The portable terminal device 50 is used as a computer configured to provide the navigation support service. The "portable terminal device 50" is, for example, that used by a crew member such as the ship operator of the pleasure boat 5.

According to the embodiment, an application program configured to achieve the navigation support service is installed on the portable terminal device 50. Hereinafter, such an application program configured to achieve the navigation support service is also referred to as a "navigation support App". The portable terminal device 50 performs, by executing the navigation support App through a processor thereof, various warnings that contribute to safety navigation as exemplary navigation support service.

As an aspect of the navigation support service, for example, the portable terminal device 50 automatically or manually notifies the server device 10 of departure and arrival of the pleasure boat 5 that the ship operator holding the portable terminal device 50 is on board from and at a ship port. This provides such port departure and arrival determination service that the notification of port departure and arrival of the pleasure boat 5 is output through a predetermined display device or a voice output device or the port departure and arrival notification of the pleasure boat 5 is uploaded to the server device 10 to record port departure and arrival in the server device 10. In addition, the portable terminal device 50 performs, over a sailing duration between port departure and arrival of the pleasure boat 5, various kinds of warnings such as a warning related to dangerous objects such as a shoal, a reef, and a fishing net, a warning related to ship operation exceeding a navigation range of the pleasure boat 5 determined based on skills and a license of the ship operator of the pleasure boat 5, the size of the boat, and the like, a warning related to entry to a restricted region such as a port or a river, a warning related to anchor dragging to the pleasure boat 5 performing anchoring, a warning related to violation of rules of a course, and a warning related to approach of all kinds of other ships including small-sized and large-sized ships.

As another aspect, the portable terminal device 50 uploads, only during the above-described sailing duration, position information measured by a position detection unit, such as a global positioning system (GPS) receiver, included in the portable terminal device 50 to the server device 10. Accordingly, the portable terminal device 50 establishes a foundation that allows the server device 10 to provide the navigation management service to the client terminal 30. The server device 10 is capable of managing, based on the foundation, for example, port departure and arrival of the pleasure boat 5 and the current position after port departure of the pleasure boat 5. In addition, the server device 10 is capable of receiving an emergency request for rescue of the pleasure boat 5 from the portable terminal device 50, setting, on a map including a port under jurisdiction of the marina and a marine area around the port, a symbol of a dangerous object for which the portable terminal device 50 sets off a warning, and displaying, in a display manner different from those of other symbols, a symbol of the pleasure boat 5 for which the portable terminal device 50 is executing the above-described various warnings among symbols of ships indicated on the map. Hereinafter, a port under jurisdiction of the marina and a marine area around the port are also referred to as a "jurisdiction zone".

Communication is performed between the server device 10 and the portable terminal device 50 through an optional network connected through a base station in which the portable terminal device 50 is housed. Although not illustrated, communication is performed between the client terminal 30 and the portable terminal device 50 in a similar manner.

[Configuration of Server Device 10]

Figure 2:
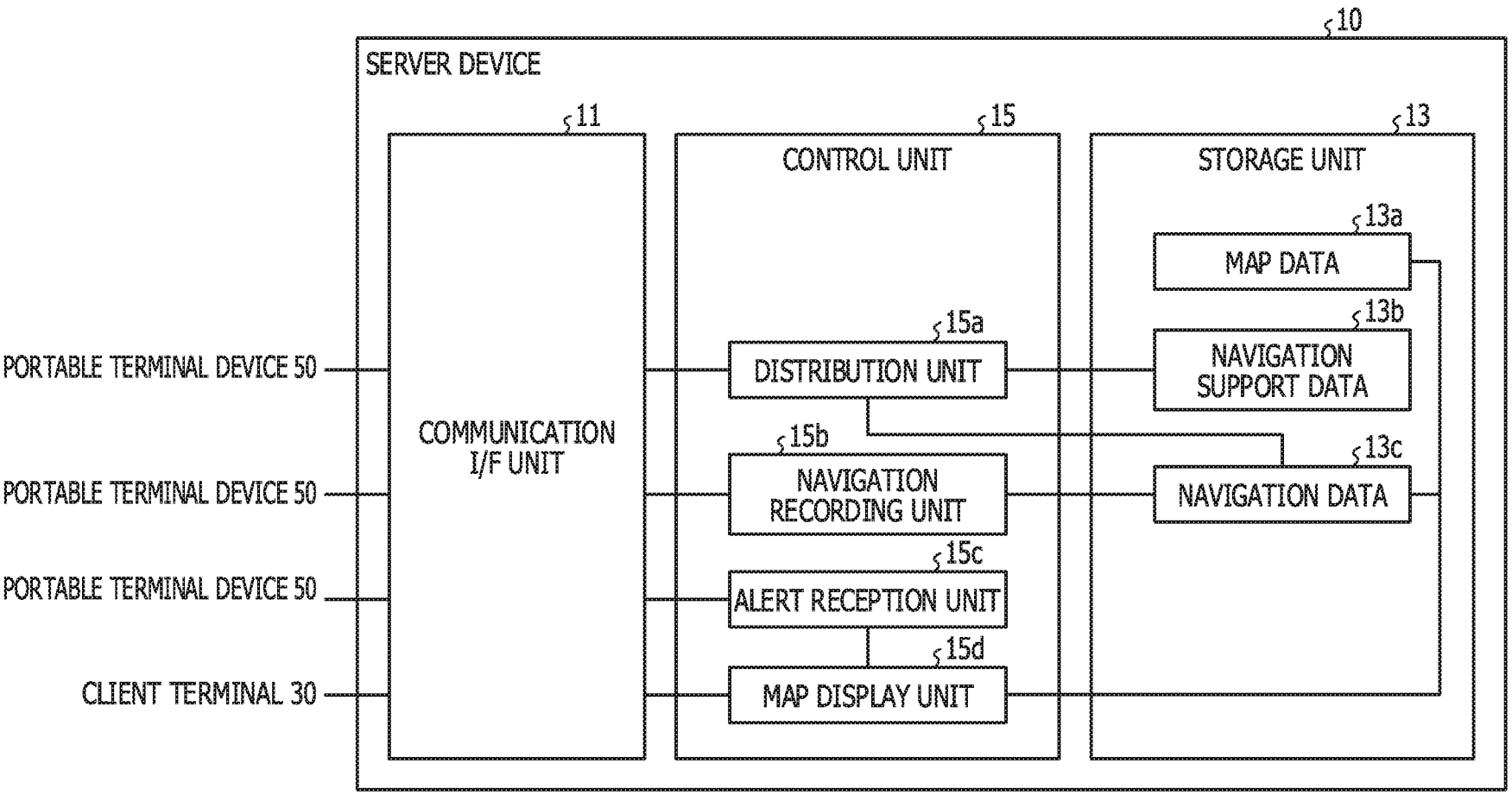
FIG. 2 is a block diagram illustrating a functional configuration of a server device according to Embodiment 1.

FIG. 2 is a block diagram illustrating a functional configuration of the server device 10 according to Embodiment 1. As illustrated in FIG. 2, the server device 10 includes a communication I/F unit 11, a storage unit 13, and a control unit 15. FIG. 2 illustrates a solid line indicating a data inputting and outputting relation only in a minimum part for the purpose of illustration. In other words, data inputting and outputting related to each processing unit is not limited the illustrated example, but any other data inputting and outputting such as data inputting and outputting between processing units, between a processing unit and data, and between a processing unit and an external device may be performed.

The communication I/F unit 11 is an interface configured to control communication with another device such as the client terminal 30 or the portable terminal device 50.

According to the embodiment, the communication I/F unit 11 may be achieved by a network interface card such as a LAN card. For example, the communication I/F unit 11 transmits display data of a map related to the jurisdiction zone of the marina to the client terminal 30, and receives, from the client terminal 30, setting of position information of a dangerous object such as a shoal, a reef, or a fishing net for which the portable terminal device 50 sets off a warning. In addition, the communication I/F unit 11 receives a request to download the navigation support App from the portable terminal device 50, position information of the pleasure boat 5, and an alert output status at the portable terminal device 50, and transmits, to the portable terminal device 50, for example, position information of a dangerous object set to the server device 10 through inputting of an instruction from the navigation support App or the client terminal 30.

The storage unit 13 is a storage device configured to store data used by various computer programs such as an operating system (OS) executed at the control unit 15 and an application program that achieves the navigation management service.

According to the embodiment, the storage unit 13 may be provided as an auxiliary storage device of the server device 10. For example, the storage unit 13 may be achieved by a hard disk drive (HDD), an optical disk, or a solid state drive (SSD). The storage unit 13 does not necessarily have to be provided as an auxiliary storage device, but may be provided as a main storage device of the server device 10. In this case, the storage unit 13 may be achieved by various semiconductor memory elements such as a random access memory (RAM) and a flash memory.

The storage unit 13 stores, as exemplary data used by a computer program executed at the control unit 15, map data 13*a*, navigation support data 13*b*, and navigation data 13*c*. In addition to the map data 13*a*, the navigation support data 13*b*, and the navigation data 13*c*, the storage unit 13 may store property information related to a ship, such as information in which a ship name, a captain name, the number of crew members are associated with each other for each ship number. Among the map data 13*a*, the navigation support data 13*b*, and the navigation data 13*c*, the navigation support data 13*b* will be described at a situation in which the navigation support data 13*b* is referred to.

The map data 13*a* is electronic data of a marine chart. The marine chart is, for example, a general chart, sailing chart, a nautical chart, a coast chart, or a harbor chart. All or some of these charts are stored in the storage unit 13 as the map data 13*a*. The map data 13*a* includes pieces obtained by dividing, in mesh, the entire map included in the map data 13*a*. Thus, when the server device 10 transmits the map data 13*a* to the client terminal 30 or the portable terminal device 50, not the entire map included in the map data 13*a* has to be transmitted, but only part of the map data 13*a* may be transmitted. For example, when the map data 13*a* is transmitted from the server device 10 to the client terminal 30, map data of the jurisdiction zone corresponding to the client terminal 30 or an element corresponding to part of the jurisdiction zone is extracted from the map data 13*a* and then transmitted. When the map data 13*a* is transmitted from the server device 10 to the portable terminal device 50, map data of an element corresponding to a predetermined range with respect to position information specified by the portable terminal device 50, in other words, a current position is extracted from the map data 13*a* and then transmitted.

The navigation data 13*c* is data related to navigation.

According to the embodiment, the navigation data 13*c* may be data including items such as a marina ID, a port departure ID, a ship ID, a port departure scheduled date and time, a port arrival scheduled date and time, a port departure date and time, a port arrival date and time, and a current position. The "marina ID" is identification information of the marina, and may be, for example, any optional system identifier as information that allows the server device 10 to identify the marina. The "port departure ID" is information for identifying a ship departing from the port managed by the marina, and is allocated with a number in the order of port departure notice submission among port departure notices having the same date of the port departure scheduled date and time. The "ship ID" is information for identifying a ship, and may be, for example, a ship number provided to the ship. The ship number is also called a "ship identification number".

Values may be registered to the items of the "port departure ID", the "ship ID", the "port departure scheduled date and time", and the "port arrival scheduled date and time", for example, when a port departure notice is submitted to the marina. For example, when a port departure notice is received online by the marina, or when a port departure notice is received online by, on behalf of the marina, a business operator that provides the navigation management service and the navigation support service, the port departure ID, the ship ID, the port departure scheduled date and time, and the port arrival scheduled date and time that are included in electronic data of the port departure notice in association with the marina ID of the marina to which the port departure notice is submitted may be registered to the storage unit 13.

Only when a port departure notification is received from the portable terminal device 50, the date and time of the reception of the port departure notification is registered to the "port departure date and time". Only when a port arrival notification is received from the portable terminal device 50, the date and time of the reception of the port arrival notification is registered to the "port arrival date and time". The "current position" is overwritten with position information uploaded from the portable terminal device 50, a status related to port departure and arrival of which is set to "departed", at each uploading in a predetermined duration, for example, one minute.

FIG. 3 is a diagram illustrating exemplary navigation data 13*c*. FIG. 3 only illustrates, as an example, records related to a marina identified by the marina ID of "M001". The exemplary navigation data 13*c* illustrated in FIG. 3 indicates that a ship identified by the ship ID of "JP-ABC12345D404" departed from the marina identified by the marina ID of "M001" and has already arrived at the marina. The exemplary navigation data 13*c* illustrated in FIG. 3 also indicates that a ship identified by the ship ID of "JP-DEF54321N505", a ship identified by the ship ID of "JP-HIJ56789J123", and a ship identified by the ship ID of "JP-HIJ98765J200" have departed from the marina identified by the marina ID of "M001". An alert of "anchor dragging" is output to the ship identified by the ship ID of "JP-DEF54321N505", and an alert of "shoal warning" is output to the ship identified by the ship ID of "JP-HIJ98765J200". No alert is output to the ship identified by the ship ID of "JP-HIJ56789J123", but a notification that the ship has been anchored, in other words, moored has been uploaded.

The above-described table is exemplary, and may have, for example, no status column or may store an additional item other than the status column. When the kind of alert is received from a data communication unit 58*e* to be described later, the kind of alert may be stored as an alert state in association with a ship ID. As long as the above-described data items are allowed to be stored in association with each other and referred to, data does not have to be collectively stored in a single table but may be managed in a divided manner in a plurality of tables.

The control unit 15 includes an internal memory configured to store various computer programs and various kinds of control data, and executes various kinds of processing based on these computer programs and control data.

According to the embodiment, the control unit 15 is achieved as a central processing unit (CPU). the control unit 15 does not necessarily have to be achieved as a central processing unit, but may be achieved as a micro processing unit (MPU). Alternatively, the control unit 15 may be achieved by a hard-wired logic such as an application specific integrated circuit (ASIC) or a field programmable gate array (FPGA).

The control unit 15 virtually achieves processing units described below by loading, as a process onto a work area of a RAM, such as a dynamic random access memory (DRAM) or a static random access memory (SRAM), mounted as a main storage device (not illustrated), the navigation management program stored in the storage unit 13 as an application program that achieves the above-described the navigation management service.

For example, as illustrated in FIG. 2, the control unit 15 includes a distribution unit 15*a*, a navigation recording unit 15*b*, an alert reception unit 15*c*, and a map display unit 15*d*.

The distribution unit 15*a* is a processing unit configured to perform distribution to the portable terminal device 50.

According to the embodiment, when having received, from the portable terminal device 50, a request to download the navigation support App, the distribution unit 15*a* distributes the navigation support data 13*b* stored in the storage unit 13 to the portable terminal device 50. The navigation support data 13*b* includes the data of the navigation support App and various kinds of data to be used by the navigation support App. Examples of the data to be used by the navigation support App include position information of a dangerous object such as a shoal, a reef, or a fishing net, which is set to the server device 10 in response to an instruction input from the client terminal 30. The distribution unit 15*a* distributes the position information of any other ship to the portable terminal device 50 for which a port departure notification is received but no port arrival notification is received. In this case, for example, the distribution unit 15*a* distributes, to the portable terminal device 50, the position information of any other ship, the current position of which is included in a predetermined range of, for example, 1 km from the current position of the portable terminal device 50 among current positions included in the navigation data 13*c*. The position information of any other ship may be distributed in a period equal to a period in which the portable terminal device 50 uploads the current position, or may be distributed in a period, such as a period in which position information is sampled by the portable terminal device 50, shorter than the period in which the portable terminal device 50 uploads the current position. In addition to the current position of the pleasure boat 5 included in the navigation data 13*c*, the distribution unit 15*a* may distribute, to the portable terminal device 50, the current position of any large-sized ship uploaded to the server device 10 through a marine instrument such as an AIS.

The navigation recording unit 15*b* is a processing unit configured to perform recording related to navigation.

According to the embodiment, when having received a port departure notification from the portable terminal device 50, the navigation recording unit 15*b* executes processing as follows. Specifically, the navigation recording unit 15*b* records the date and time of reception of the port departure notification to the port departure date and time of a record having a marina ID and a port departure ID identical to those included in the port departure notification among records stored as the navigation data 13*c* in the storage unit 13. In this example, it is assumed that duplicate port departure IDs are allocated to marinas, and both of a marina ID and a port departure ID are used to search records. However, the record search may be performed by only using the port departure ID when different port departure IDs are allocated to marinas. When having received a port arrival notification from the portable terminal device 50, the navigation recording unit 15*b* executes processing as follows. Specifically, the navigation recording unit 15*b* records the date and time of reception of the port arrival notification to the port arrival date and time of a record having a marina ID and a port departure ID identical to those included in the port arrival notification among records stored as the navigation data 13*c* in the storage unit 13. The navigation recording unit 15*b* also executes processing as follows each time position information is notified from the portable terminal device 50. Specifically, the navigation recording unit 15*b* overwrites and updates the position information with the current position of a record having a marina ID and a port departure ID identical to those notified together with the position information among records stored as the navigation data 13*c* in the storage unit 13.

The alert reception unit 15*c* is a processing unit configured to receive an alert execution notification from the portable terminal device 50.

According to the embodiment, when an alert is output at the portable terminal device 50, the alert reception unit 15*c* receives, from the portable terminal device 50, an alert execution notification including the kind of the alert output at the portable terminal device 50.

The map display unit 15*d* is a processing unit configured to cause the client terminal 30 display a map.

According to the embodiment, when a request to browse a monitoring screen is received on a menu screen (not illustrated) displayed on the client terminal 30, the map display unit 15*d* executes processing as follows. For example, the map display unit 15*d* specifies a marina ID from an account used, at login authentication, by the client terminal 30 having issued a request to set the monitoring screen. Subsequently, the map display unit 15*d* further specifies a jurisdiction zone corresponding to the specified marina ID by referring to jurisdiction data (not illustrated) in which the marina ID of each marina is associated with the jurisdiction zone of the marina. Then, the map display unit 15*d* extracts, from the map data 13*a* stored in the storage unit 13, map data including the jurisdiction zone corresponding to the specified marina ID. Thereafter, the map display unit 15*d* causes the client terminal 30 to display a monitoring screen including the extracted map of the jurisdiction zone of the marina.

For example, any record having a registered current position is extracted from among records included in the navigation data 13*c*, and then the current position of any ship included in the record may be mapped on the map of the jurisdiction zone of the marina included in the above-described monitoring screen. When the current position of a ship is mapped in this manner, the client terminal 30 may display, for example, property information related to the ship in association with a symbol indicating the ship. The property information of a ship may be displayed on a window different from the monitoring screen. Moreover, among symbols of ships mapped on the map of the jurisdiction zone of the marina, the symbol of a ship from which an alert execution notification is received by the alert reception unit 15*c* may be displayed on the monitoring screen in a display manner different from that for the symbol of any other ship. In this case, the symbol of this ship may be displayed in a display manner that further differs between the kinds of outputting on the portable terminal device 50.

[Configuration of Portable Terminal Device 50]

Figure 4:
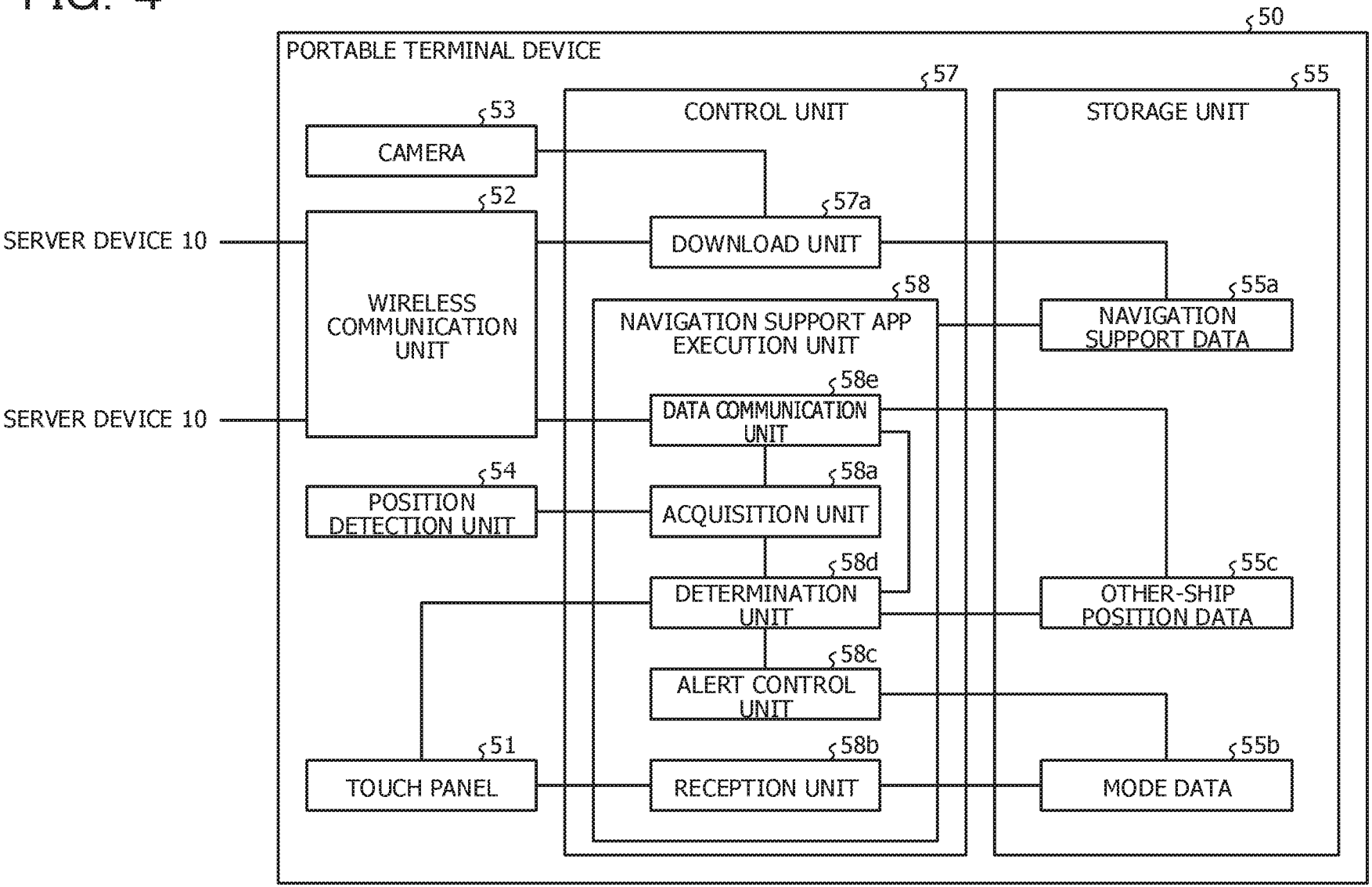
FIG. 4 is a block diagram illustrating a functional configuration of a portable terminal device according to Embodiment 1.

FIG. 4 is a block diagram illustrating a functional configuration of the portable terminal device 50 according to Embodiment 1. As illustrated in FIG. 4, the portable terminal device 50 includes a touch panel 51, a wireless communication unit 52, a camera 53, a position detection unit 54, a storage unit 55, and a control unit 57. The portable terminal device 50 may include various functional components, such as a voice output unit, included in a known portable terminal device in addition to functional components illustrated in FIG. 4.

The touch panel 51 is a device capable of performing display and receiving inputting.

As an aspect related to display, the touch panel 51 displays images output from an OS executed on the portable terminal device 50 and an application program such as the navigation support App. As an aspect related to input, the touch panel 51 receives touch operations such as tap, flick, swipe, pinch-in, and pinch-out performed on a screen of the touch panel 51. In this example, the touch panel 51 is described as an exemplary display unit, but does not necessarily have to provide both displaying and inputting functions. The touch panel 51 may be achieved by a device having the displaying function.

The wireless communication unit 52 is a processing unit configured to connect with the base station through an antenna (not illustrated) to perform data transmission and reception to and from any other device such as the server device 10 through, for example, a mobile communication network connected with the base station.

The camera 53 is an image capturing apparatus configured to capture images.

According to the embodiment, the camera 53 includes an image sensor such as a charge coupled device (CCD) or a complementary metal oxide semiconductor (CMOS). For example, the camera 53 may include light receiving elements of three kinds such as R (red), G (green), and B (blue).

The position detection unit 54 is a kind of hardware configured to detect the position of the portable terminal device 50.

According to the embodiment, the position detection unit 54 may be a GPS receiver configured to detect a position based on time information transmitted from a plurality of GPS satellites. The position detected by the GPS receiver in this manner does not necessarily have to be directly used, but may be subjected to various kinds of correction by using, for example, position information transmitted from the base station connected with the portable terminal device 50.

The storage unit 55 is a storage device configured to store the OS executed by the control unit 57 and data used by various computer programs such as application programs.

According to the embodiment, the storage unit 55 may be provided as a main storage device of the server device 10. For example, the storage unit 55 may be achieved by various semiconductor memory elements such as a RAM such as a DRAM or a SRAM and a flash memory. The storage unit 55 does not necessarily have to be provided as a main storage device, but may be provided as an auxiliary storage device of the portable terminal device 50. In this case, the storage unit 55 may be achieved by a HDD, an optical disk, or a SSD.

The storage unit 55 stores, as exemplary data used by a computer program executed by the control unit 57, navigation support data 55*a*, mode data 55*b*, and other-ship position data 55*c*. In addition to the navigation support data 55*a*, the mode data 55*b*, and the other-ship position data 55*c*, the storage unit 55 may store user data of the portable terminal device 50.

The control unit 57 is a processing unit configured to govern entire control of the portable terminal device 50.

According to the embodiment, the control unit 57 is provided as a central processing unit (CPU). The control unit 57 does not necessarily have to be provided as a central processing unit, but may be provided as an MPU. The control unit 57 may be achieved by a hard-wired logic such as an ASIC or an FPGA.

As illustrated in FIG. 4, the control unit 57 includes a download unit 57*a* and a navigation support App execution unit 58.

The download unit 57*a* is a processing unit configured to execute various kinds of downloading.

The following describes an exemplary method of downloading the navigation support App installed on the portable terminal device 50. For example, downloading of the above-described navigation support App starts when a two-dimensional bar code issued by the marina is read through the camera 53 of the portable terminal device 50. Such a two-dimensional bar code is read, for example, when a port departure notice is submitted to the marina. Once the port departure notice is submitted to the marina in this manner, a port departure ID is allocated by the server device 10, and then a new record in which, for example, the port departure ID, the marina ID of the marina having received the port departure notice, a ship ID, a port departure scheduled date and time, and a port arrival scheduled date and time received through the port departure notice are associated with each other is generated in the navigation data 13*c*. Thereafter, address information such as a uniform resource locator (URL) through which the server device 10 is accessed, the marina ID, and the port departure ID are coded. In this manner, a two-dimensional bar code including the marina ID and the port departure ID is generated. Thereafter, the two-dimensional bar code including the URL, the marina ID, and the port departure ID is read by capturing, through the camera 53, a sheet on the two-dimensional bar code is output by printing or a screen of a display device on which the two-dimensional bar code is displayed.

When the two-dimensional bar code including the URL, the marina ID, and the port departure ID is read in this manner, the download unit 57*a* transmits, by referring to the address of the URL, a request to download the navigation support App including the marina ID and the port departure ID to the server device 10. As a result, the navigation support App included in the navigation support data 13*b*, and navigation support data including various kinds of data used by the navigation support App are downloaded as the navigation support data 55*a* from the server device 10. In addition, for example, the marina ID and the port departure ID are registered to the storage unit 55 for identification of a marina to which the pleasure boat 5 belongs and the pleasure boat 5 itself by the server device 10. Thereafter, the download unit 57*a* activates the navigation support App downloaded from the server device 10 by loading the navigation support App execution unit 58 onto a work area of a RAM such as the storage unit 55.

The activation of the navigation support App allows the portable terminal device 50 to start providing the navigation support service. After the activation at the portable terminal device 50, the navigation support App continues operating on background until completion of port departure and port arrival submitted through the port departure notice, irrespective of any operation to end the navigation support App by a user.

As illustrated in FIG. 4, the navigation support App execution unit 58 includes an acquisition unit 58*a*, a reception unit 58*b*, an alert control unit 58*c*, a determination unit 58*d*, and the data communication unit 58*e*.

The acquisition unit 58*a* is a processing unit configured to acquire position information.

According to the embodiment, the acquisition unit 58*a* acquires position information from the position detection unit 54 at each position detection by the position detection unit 54. The acquired position information is, for example, latitude and longitude coordinates. The following description assumes an example in which position information sampled in predetermined period, for example, five seconds by the position detection unit 54 is acquired.

The reception unit 58*b* is a processing unit configured to receive an input of an anchorage instruction or an input indicating an anchorage state.

According to the embodiment, when the pleasure boat 5 includes a marine instrument configured to automatically perform anchorage, the reception unit 58*b* receives an input anchorage instruction received by the marine instrument through forwarding of the input anchorage instruction from the marine instrument to the portable terminal device 50. In this case, when having received an anchorage operation to the marine instrument, the marine instrument of the pleasure boat 5 executes control to execute automatically anchorage and processing of forwarding the anchorage instruction to the portable terminal device 50. The reception unit 58*b* may receive, through an input device such as the touch panel 51, an input instructing transition of the pleasure boat 5 to a mooring state. In this case, the reception unit 58*b* causes the touch panel 51 to display an anchorage button indicating anchorage of the pleasure boat 5 or a mooring button indicating mooring of the pleasure boat 5. Through reception of an operation of pressing any of these buttons, the reception unit 58*b* receives an input indicating the anchorage state.

When it is recognized by the portable terminal device 50 in this manner that the pleasure boat 5 is in the mooring state, the reception unit 58*b* sets the mode data 55*b* stored in the storage unit 55 to a mooring mode indicating the mooring state. Thereafter, when an anchor lifting operation is received by the above-described marine instrument or when an operation of pressing an anchor lifting button indicating that anchor lifting is performed at the pleasure boat 5 or a navigation button indicating that the pleasure boat 5 is under navigation is received, the reception unit 58*b* sets the mode data 55*b* stored in the storage unit 55 to a navigation mode indicating a navigation state.

The alert control unit 58*c* is a processing unit configured to reduce the number of kinds of triggers for outputting an alert in accordance with the mode data 55*b*.

According to the embodiment, depending on whether the mode data 55*b* stored in the storage unit 55, in other words, a stay mode is the "navigation mode" or the "mooring mode", the alert control unit 58*c* changes the kind of an alert, outputting of which is to be determined by the determination unit 58*d* described later, to reduce the number of kinds of triggers for outputting an alert. Specifically, when the stay mode is the "mooring mode", the alert control unit 58*c* does not execute dangerous object determination performed when the stay mode is the navigation mode". In other words, when the pleasure boat 5 stays in the mooring mode in which the risk of approach to dangerous objects such as a shoal, a reef, and a fishing net is lower than when the stay mode is the navigation mode, the alert control unit 58*c* omits dangerous object determination thereof to suppress alert outputting when the determination would find that a dangerous object exists in front of the pleasure boat 5.

More specifically, when the stay mode is the "navigation mode", the alert control unit 58*c* causes the determination unit 58*d* to execute first determination processing as described below. For example, the "first determination processing" includes "dangerous object determination" that determines whether any dangerous object exists in front of the pleasure boat 5, and "other-ship approach determination" that determines whether any other ship is approaching into a predetermined range from the current position of the pleasure boat 5. When the stay mode is the "mooring mode", the alert control unit 58*c* causes the determination unit 58*d* to execute second determination processing as described below. For example, the "second determination processing" does not include the above-described "dangerous object determination", but includes the above-described "other-ship approach determination" and "anchor dragging determination" that determines whether the pleasure boat 5 is dragging the anchor.

The determination unit 58*d* is a processing unit configured to determine whether to output various alerts.

According to the embodiment, when the "first determination processing" is selected by the alert control unit 58*c*, the determination unit 58*d* executes the "dangerous object determination" and the "other-ship approach determination". When the "second determination processing" is selected by the alert control unit 58*c*, the determination unit 58*d* executes "the anchor dragging determination" and the "other-ship approach determination". The following specifically describes the three kinds of determination methods of the "other-ship approach determination", the "dangerous object determination", and "the anchor dragging determination".

(1) Other-Ship Approach Determination

Figure 5:
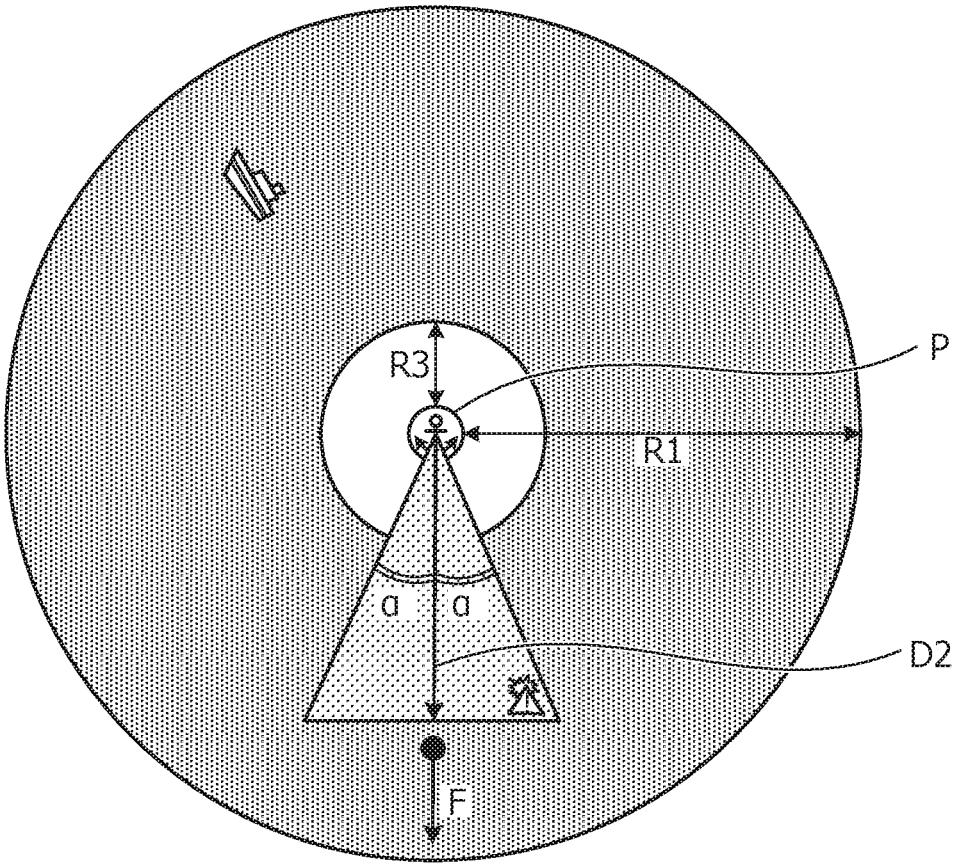
FIG. 5 is a diagram illustrating an exemplary other-ship approach identification range, an exemplary dangerous object identification range, and an exemplary non-anchor dragging identification range.

The determination unit 58*d* sets, based on position information acquired by the acquisition unit 58*a*, a range identifying that any other ship has approached to the pleasure boat 5 corresponding to the portable terminal device 50. Hereinafter, the range for identifying that any other ship has approached to the pleasure boat 5 corresponding to the portable terminal device 50 is also referred to as an "other-ship approach identification range". FIG. 5 is a diagram illustrating an exemplary other-ship approach identification range, an exemplary dangerous object identification range, and an exemplary non-anchor dragging identification range. As illustrated in FIG. 5, the determination unit 58*d* sets the other-ship approach identification range to be the range of a radius R1 from a current position P of the portable terminal device 50 on the pleasure boat 5, for example, the darkest hatched part illustrated in FIG. 5. The radius R1 is, for example, 500 m.

Once the other-ship approach identification range is set, the determination unit 58*d* refers to the other-ship position data 55*c* stored in the storage unit 55. The other-ship position data 55*c* is the position information of other ships, for example, general ships including small-sized and large-sized ships, and is registered through, for example, downloading from the server device 10 by the data communication unit 58*e* to be described later. The determination unit 58*d* determines whether the position information of any other ship included in the other-ship position data 55*c* is included in the above-described other-ship approach identification range. When the position information of any other ship is included in the other-ship approach identification range, it is determined that any other ship is approaching to the pleasure boat 5. In this case, the determination unit 58*d* outputs a message telling that any other ship is approaching to the pleasure boat 5 as an alert through display on the touch panel 51, or outputs a sound effect telling that any other ship is approaching to the pleasure boat 5 or the above-described message as an alert by voice through a speaker (not illustrated) or the like.

(2) Dangerous Object Determination

The determination unit 58*d* sets, based on position information acquired by the acquisition unit 58*a*, a range for identifying that any dangerous object such as a shoal, a reef, or a fishing net exists in front of the pleasure boat 5. Hereinafter, the range identifying that any dangerous object exists in front of the pleasure boat 5 is also referred to as a "dangerous object identification range". The dangerous object identification range is set, for example, on the front side of the pleasure boat 5 in the traveling direction. For example, as illustrated in FIG. 5, the determination unit 58*d* specifies a traveling direction F of the pleasure boat 5 based on position information change determined from the position information acquired by the acquisition unit 58*a*, and past position information previously acquired, for example, position information acquired one hour before. Then, the determination unit 58*d* sets the dangerous object identification range to be the range of a predetermined distance D2, for example, 300 m from the current position P of the portable terminal device 50 on the pleasure boat 5 in the traveling direction F of the pleasure boat 5, the range extending in the clockwise and anticlockwise directions from the traveling direction F of the pleasure boat 5 by a predetermined angle α, for example, 15 [degrees] centered at the current position P of the portable terminal device 50 on the pleasure boat 5, which is illustrated as the second darkest hatched part in FIG. 5. The angle α may be increased or decreased in accordance with weather data such as the direction and magnitude of wind and the direction and magnitude of wave. For example, the angle α may be set to be larger as the direction and magnitude of wind and the direction and magnitude of wave increase.

Once the dangerous object identification range is set, the determination unit 58*d* refers to the position information of any dangerous object included in the navigation support data 55*a* stored in the storage unit 55. Then, the determination unit 58*d* determines whether the position information of any dangerous object is included in the dangerous object identification range. When the position information of any dangerous object is included in the dangerous object identification range, it is determined that the dangerous object exists in front of the pleasure boat 5. In this case, the determination unit 58*d* outputs a message telling that the dangerous object exists in front of the pleasure boat 5 as an alert through display on the touch panel 51, or outputs a sound effect telling that the dangerous object exists in front of the pleasure boat 5 or the above-described message as an alert by voice through a speaker (not illustrated) or the like.

(3) Anchor Dragging Determination

The determination unit 58*d* sets, based on the position information acquired by the acquisition unit 58*a*, a range for identifying that the pleasure boat 5 of a crew member holding the portable terminal device 50 is not in an anchor dragging state. Hereinafter, the range for identifying that the pleasure boat 5 is not in the anchor dragging state is also referred to as a "non-anchor dragging identification range". For example, when the mode data 55*b* stored in the storage unit 55, in other words, the stay mode is set to the "mooring mode" at the current position P of the portable terminal device 50 on the pleasure boat 5 illustrated in FIG. 5, the determination unit 58*d* sets the non-anchor dragging identification range to be the range of a radius R3 from an anchorage position P at which the pleasure boat 5 is anchored, for example, the white hatched part illustrated in FIG. 5.

Figure 6:
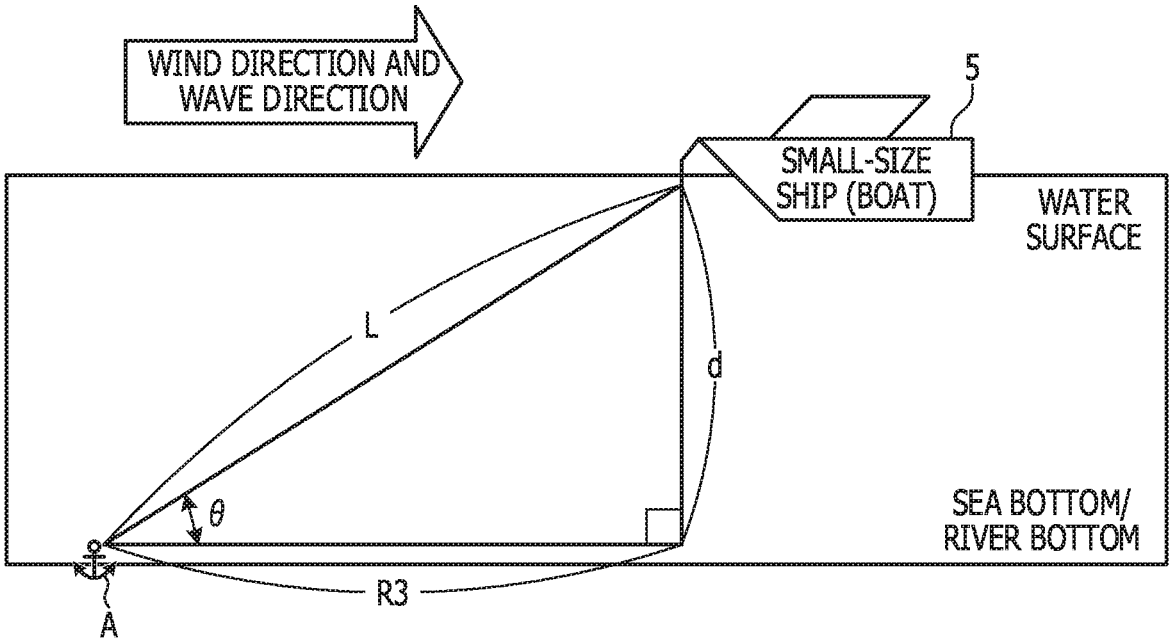
FIG. 6 is a diagram illustrating an exemplary method of setting the non-anchor dragging identification range.

The following describes an exemplary method of setting the radius R3. FIG. 6 is a diagram illustrating the exemplary method of setting the non-anchor dragging identification range. As illustrated in FIG. 6, when being anchored, the pleasure boat 5 is swung on a concentric circle centered at a position A of the anchor due to influence of the direction of wind and the direction of wave. Thus, a length L of an anchor rope, which differs depending on the strength of wind, the strength of wave, and the weight and area of the ship, is preferably estimated to be, for example, three to five times larger than a water depth d. In addition, an angle θ of the anchor rope is preferably estimated to be closer to 10° when weather such as the strength of wind and the strength of wave is bad, or equal to or smaller than 20° when weather is normal. Otherwise, anchor dragging would potentially occur.

The water depth d, the length L of the anchor rope, and the angle θ of the anchor rope may be acquired as known values at a timing when the stay mode is set to the "mooring mode". For example, the pleasure boat 5 often includes a water depth measurement device such as a sonar, and thus a value measured by the water depth measurement device may be acquired as the water depth d through the touch panel 51 or the like. Once the water depth d is acquired in this manner, a recommendation value of the length L of the anchor rope may be calculated by multiplying the water depth d by a predetermined multiplier, for example, three. The recommendation value of the length L of the anchor rope may be displayed on the touch panel 51 when the water depth d is input, thereby instructing the length of the anchor rope appropriate for the water depth to a crew member of the pleasure boat 5. In addition, the angle θ of the anchor rope may be set based on inputting of the state of weather through the touch panel 51. For example, inputting of any of "good" weather and "bad" weather may be received through the touch panel 51: the angle θ of the anchor rope is set to be 19° when "good" weather is input, or is set to be 11° when "bad" weather is input. Such inputting may be omitted so that a value such as 19°, which is equal to or smaller than 20° as an upper limit value is used as a fixed value.

When the water depth d, the length L of the anchor rope, and the angle θ of the anchor rope are known in this manner, the radius R3 of a non-anchor dragging recognition range as an upper limit distance up to which the pleasure boat 5 is allowed to deviate from the position A of the anchor may be calculated according to the Pythagorean theorem. Specifically, the radius R3 of the non-anchor dragging recognition range may be calculated by substituting the water depth d and the length L of the anchor rope into Expression (1) below. For example, when the water depth d is 10 m and the length L of the anchor rope is 30 m, the radius R3 of the non-anchor dragging recognition range is calculated to be 28.2° according to Expression (1) below.

$$R3=\sqrt{L^2-d^2} \tag{1}$$

In addition, the angle θ of the anchor rope may be calculated by substituting the water depth d and the length L of the anchor rope into Expression (2) below that calculates the inverse trigonometric function of sine. Moreover, an appropriate length L' of the anchor rope may be further calculated from the calculated angle θ of the anchor rope and the water depth d, and displayed on the touch panel 51 or the like.

$$\theta = \sin^{-1}\frac{d}{L} \tag{2}$$

Once the non-anchor dragging recognition range is set in this manner, the determination unit 58*d* determines whether the position information acquired by the acquisition unit 58*a*, which is the current position of the pleasure boat 5, deviates from the non-anchor dragging identification range. When the current position of the pleasure boat 5 deviates from the non-anchor dragging identification range, it is determined that the pleasure boat 5 is dragging the anchor. In this case, the determination unit 58*d* outputs a message telling that the pleasure boat 5 is dragging the anchor as an alert through display on the touch panel 51, or outputs a sound effect telling that the pleasure boat 5 is dragging the anchor or the above-described message as an alert by voice through a speaker (not illustrated) or the like.

As illustrated FIG. 4, the data communication unit 58*e* is a processing unit configured to perform communication such as data uploading and downloading with the server device 10.

According to the embodiment, when a port arrival operation or a port departure operation is received through the touch panel 51, the data communication unit 58*e* uploads a port departure notification or a port arrival notification to the server device 10. The data communication unit 58*e* also uploads, only during a sailing duration from reception of a port departure operation to reception of a port arrival operation through the touch panel 51, position information measured by the position detection unit 54 to the server device 10. The position information may be uploaded at each measurement of position information by the position detection unit 54, but may be uploaded in a period longer than a period in which the position detection unit 54 samples the position information. In addition, after the port arrival operation is performed through the touch panel 51, the data communication unit 58*e* downloads the position information of any other ship from the server device 10. The position information of any other ship downloaded in this manner is registered as the other-ship position data 55*c* to the storage unit 55. In addition, at each alert outputting based on the determination by the determination unit 58*d*, the data communication unit 58*e* uploads an alert execution notification including the kind of the alert, a marina ID, and a port departure ID to the server device 10.

[Processing Process]

The following describes the process of processing at a navigation support management system according to the present embodiment. The following description will be first made on (1) alert control processing executed by the portable terminal device 50, and then made on (2) the first determination processing and (3) the second determination processing executed as subroutines of the alert control processing.

(1) Alert Control Processing

Figure 7:
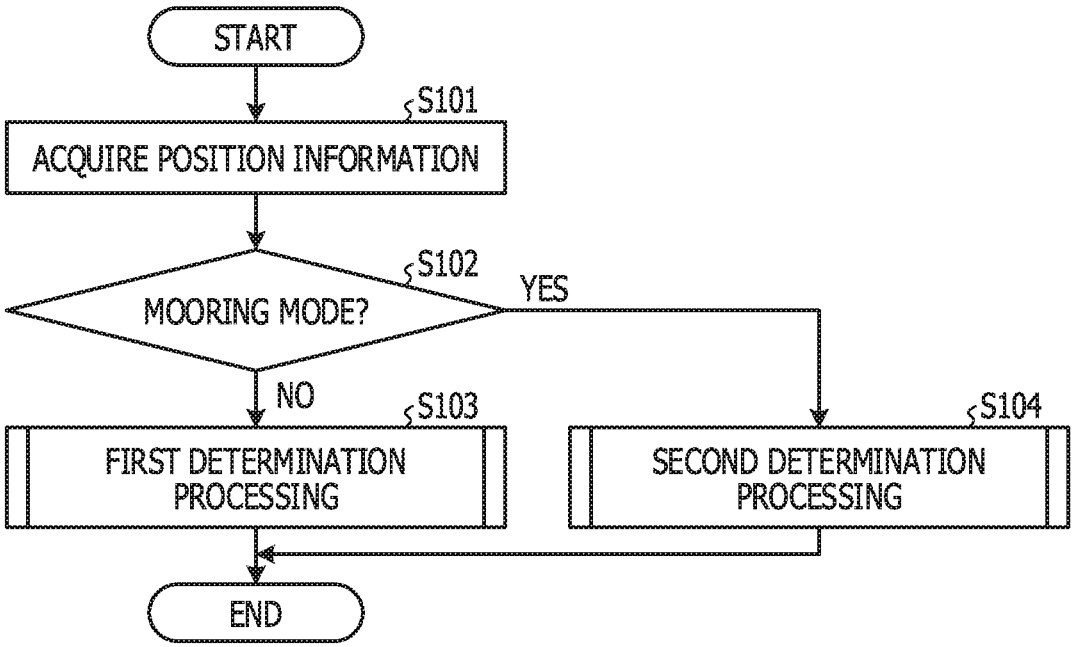
FIG. 7 is a flowchart illustrating the procedure of alert control processing according to Embodiment 1.

FIG. 7 is a flowchart illustrating the procedure of the alert control processing according to Embodiment 1. For example, the processing is repeatedly executed during a sailing duration from reception of a port departure operation to reception of a port arrival operation through the touch panel 51. The following description will be made with an example in which port departure and port arrival events are received through the touch panel 51, but a sailing duration may be specified by automatically determining departure and arrival of the pleasure boat 5 from and at a port by using an existing technology.

As illustrated in FIG. 7, when position information is acquired by the acquisition unit 58*a* (step S101), the alert control unit 58*c* determines whether the mode data 55*b* stored in the storage unit 55, in other words, the stay mode is the "mooring mode" (step S102).

When the stay mode is not the "mooring mode", in other words, when the stay mode is the "navigation mode" (No at step S102), the alert control unit 58*c* causes the determination unit 58*d* to execute the first determination processing including the "dangerous object determination" and the "other-ship approach determination" (step S103), and then the process ends.

When the stay mode is the "mooring mode" (Yes at step S102), the alert control unit 58*c* causes the determination unit 58*d* to execute the second determination processing including "the anchor dragging determination" and the "other-ship approach determination" (step S104), and then the process ends.

(2) First Determination Processing

Figure 8:
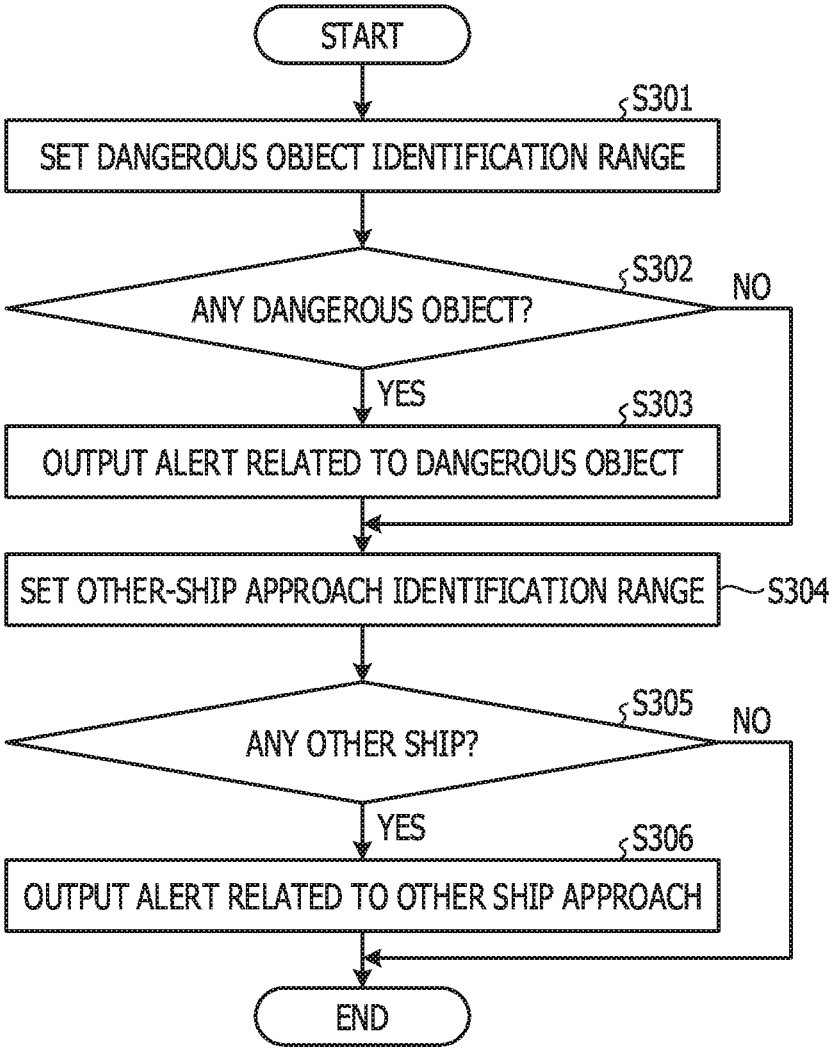
FIG. 8 is a flowchart illustrating the procedure of first determination processing illustrated in FIG. 7.

FIG. 8 is a flowchart illustrating the procedure of the first determination processing illustrated in FIG. 7. This processing corresponds to the processing at step S103 illustrated in FIG. 7, and is executed, for example, when the stay mode is the "navigation mode".

As illustrated in FIG. 8, the determination unit 58*d* sets the dangerous object identification range in accordance with the position information acquired at step S101, in other words, the current position of the pleasure boat 5 (step S301). For example, the determination unit 58*d* specifies a locus between the current position of the pleasure boat 5 and a position acquired in the past, in other words, the traveling direction F of the pleasure boat 5, and sets the dangerous object identification range to be a range equal to or smaller than a predetermined distance from the current position of the pleasure boat 5 in the traveling direction F of the pleasure boat 5, the range extending in the clockwise and anticlockwise directions from the traveling direction F of the pleasure boat 5 by a predetermined angle centered at the current position of the pleasure boat 5.

Thereafter, the determination unit 58*d* determines whether the position information of any dangerous object included in the navigation support data 55*a* stored in the storage unit 55 is included in the dangerous object identification range set at step S301 (step S302).

When the position information of any dangerous object is included in the dangerous object identification range (Yes at step S302), it is determined that the dangerous object exists in front of the pleasure boat 5. In this case, the determination unit 58*d* outputs a message telling that the dangerous object exists in front of the pleasure boat 5 as an alert through display on the touch panel 51, or outputs a sound effect telling that the dangerous object exists in front of the pleasure boat 5 or the above-described message as an alert by voice through a speaker (not illustrated) or the like (step S303). When the position information of any dangerous object is not included in the dangerous object identification range (No at step S302), the process skips the processing at step S303 and transitions to processing at step S304.

Subsequently, the determination unit 58*d* sets the other-ship approach identification range to be the range of a predetermined radius from the current position of the pleasure boat 5 acquired at step S101 (step S304). Then, the determination unit 58*d* determines whether the position information of any other ship included in the other-ship position data 55*c* is included in the other-ship approach identification range set at step S304 (step S305).

When the position information of any other ship is included in the other-ship approach identification range (Yes at step S305), it is determined that any other ship is approaching to the pleasure boat 5. In this case, the determination unit 58*d* outputs a message telling that any other ship is approaching to the pleasure boat 5 as an alert through display on the touch panel 51, or outputs a sound effect telling that any other ship is approaching to the pleasure boat 5 or the above-described message as an alert by voice through a speaker (not illustrated) or the like (step S306), and then the process ends. When the position information of any other ship is not included the other-ship approach identification range (No at step S305), the processing at step S306 is skipped and the process ends.

(3) Second Determination Processing

Figure 9:
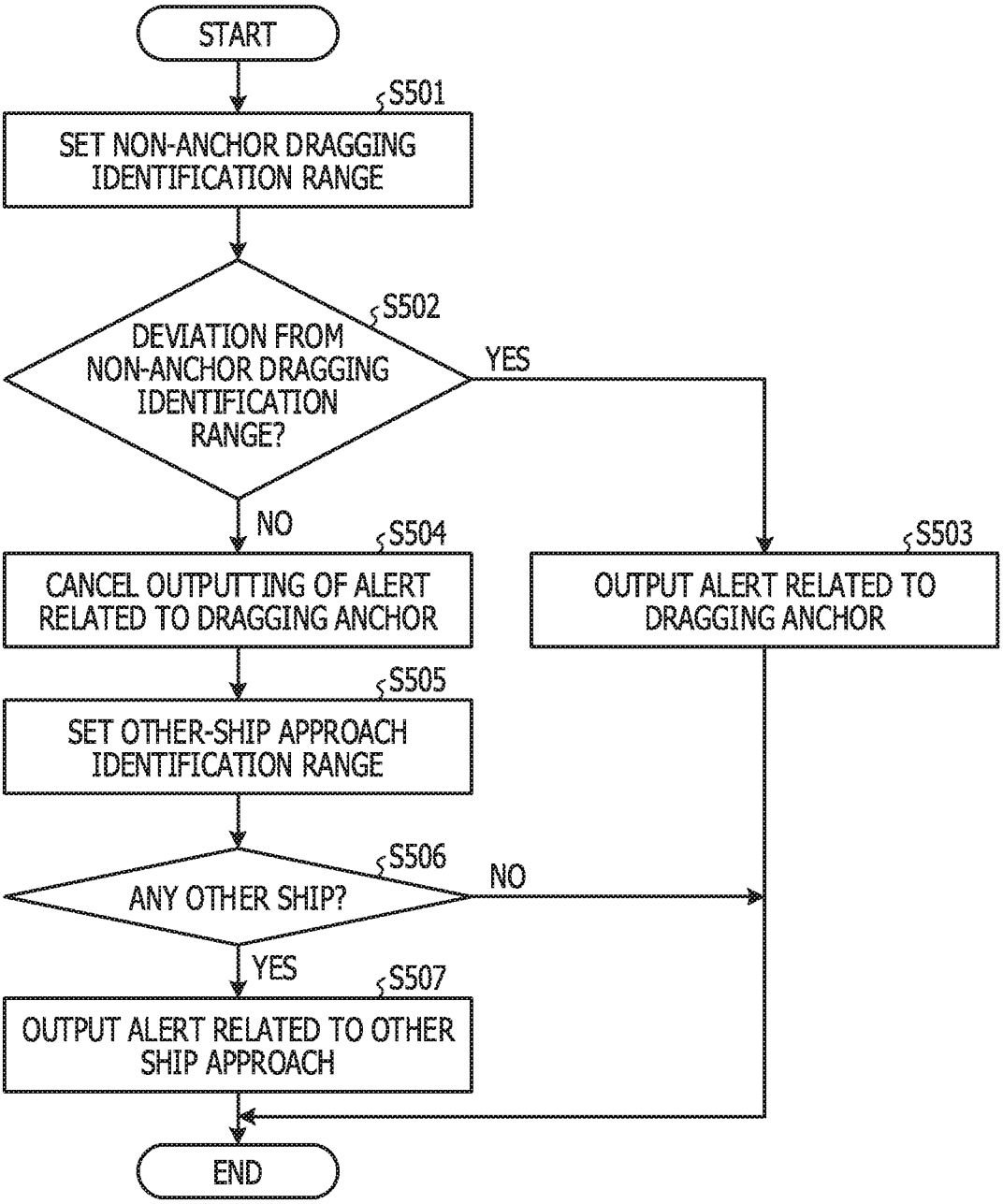
FIG. 9 is a flowchart illustrating the procedure of second determination processing illustrated in FIG. 7.

FIG. 9 is a flowchart illustrating the procedure of the second determination processing illustrated in FIG. 7. This processing corresponds to the processing at step S104 illustrated in FIG. 7, and is executed, for example, when the stay mode is the "mooring mode".

As illustrated in FIG. 9, when the pleasure boat 5 is anchored, in other words, when inputting of an anchorage instruction is received by the reception unit 58*b*, the determination unit 58*d* sets the non-anchor dragging identification range to be the range of a predetermined radius from the anchorage position P as the position information acquired by the acquisition unit 58*a* (step S501).

Then, the determination unit 58*d* determines whether the current position of the pleasure boat 5 acquired at step S101 deviates from the non-anchor dragging identification range set at step S501 (step S502).

When the current position of the pleasure boat 5 deviates from the non-anchor dragging identification range (Yes at step S502), it is determined that the pleasure boat 5 is dragging the anchor. In this case, the determination unit 58*d* outputs a message telling that the pleasure boat 5 is dragging the anchor as an alert through display on the touch panel 51, or outputs a sound effect telling that the pleasure boat 5 is dragging the anchor or the above-described message as an alert by voice through a speaker (not illustrated) or the like (step S503), and then the process ends.

When the current position of the pleasure boat 5 is included in the non-anchor dragging identification range (No at step S502), the determination unit 58*d* cancels outputting of an alert related to anchor dragging (step S504). Specifically, when an alert related to anchor dragging has been output based on position information sampled before the position information sampling at step S101, the alert outputting is canceled. When no alert related to anchor dragging has been output, the processing at step S504 is skipped.

Thereafter, the determination unit 58*d* sets the other-ship approach identification range to be the range of a predetermined radius from the current position of the pleasure boat 5 acquired at step S101 (step S505). Then, the determination unit 58*d* determines whether the position information of any other ship included in the other-ship position data 55*c* is included in the other-ship approach identification range set at step S505 (step S506).

When the position information of any other ship is included in the other-ship approach identification range (Yes at step S506), it is determined that any other ship is approaching to the pleasure boat 5. In this case, the determination unit 58*d* outputs a message telling that any other ship is approaching to the pleasure boat 5 as an alert through display on the touch panel 51, or outputs a sound effect telling that any other ship is approaching to the pleasure boat 5 or the above-described message as an alert by voice through a speaker (not illustrated) or the like (step S507), and then the process ends. When the position information of any other ship is not included in the other-ship approach identification range (No at step S506), the processing at step S507 is skipped and the process skips ends.

[Aspects of Effects]

As described above, the navigation management support system 1 according to the present embodiment reduces the number of kinds of triggers for outputting an alert, in response to inputting of an anchorage instruction to the pleasure boat 5 or inputting of the anchorage state of the pleasure boat 5. In this manner, the navigation management support system 1 according to the present embodiment reduces outputting of alerts unnecessary for a ship operator.

Embodiment 2

Although the embodiment related to devices according to the disclosure is described above, the present disclosure may be achieved in various kinds of different configurations other than the above-described embodiment. The following describes any other embodiment included in the disclosure.

[Processing Executor]

In Embodiment 1 described above, the processing illustrated in FIGS. 7 to 9 is executed by the portable terminal device 50, but the executor of the processing is not limited to the portable terminal device 50. Specifically, the processing illustrated in FIGS. 7 to 9 may be executed by the server device 10. In this case, the server device 10 may execute the navigation support App on a processor. Specifically, the server device 10 stores, in the storage unit 13, the navigation data 13*c* as distribution original data of the other-ship position data 55*c*, and the navigation support data 13*b* corresponding to the navigation support data 55*a*. Accordingly, the server device 10 is capable of executing the processing illustrated in FIGS. 7 to 9 by setting a storage region for storing the mode data 55*b* to the storage unit 13 and periodically transmitting position information from the portable terminal device 50 to the server device 10.

The components of each device illustrated in the drawings do not necessarily have to be physically configured as illustrated. Specifically, a specific configuration of separation and integration of the devices is not limited to that illustrated in the drawings, but all or part of the configuration may be functionally or physically separated or integrated in arbitrary units in accordance with, for example, various loads and use statuses. For example, the distribution unit 15*a*, the navigation recording unit 15*b*, the alert reception unit 15*c* or the map display unit 15*d* may be provided as an external device of the server device 10 and connected with the server device 10 through a network. In addition, part or all of the processing units included in the navigation support App execution unit 58 may be provided as external devices of the portable terminal device 50 and connected with the portable terminal device 50 through a network.

[Alert Control Program]

The various kinds of processing described in the above-described embodiments may be achieved by a computer, such as a personal computer or a work station, executing a computer program prepared in advance. The following describes, with reference to FIG. 10, an exemplary computer configured to execute an alert control program having functions same as those in the above-described embodiments.

Figure 10:
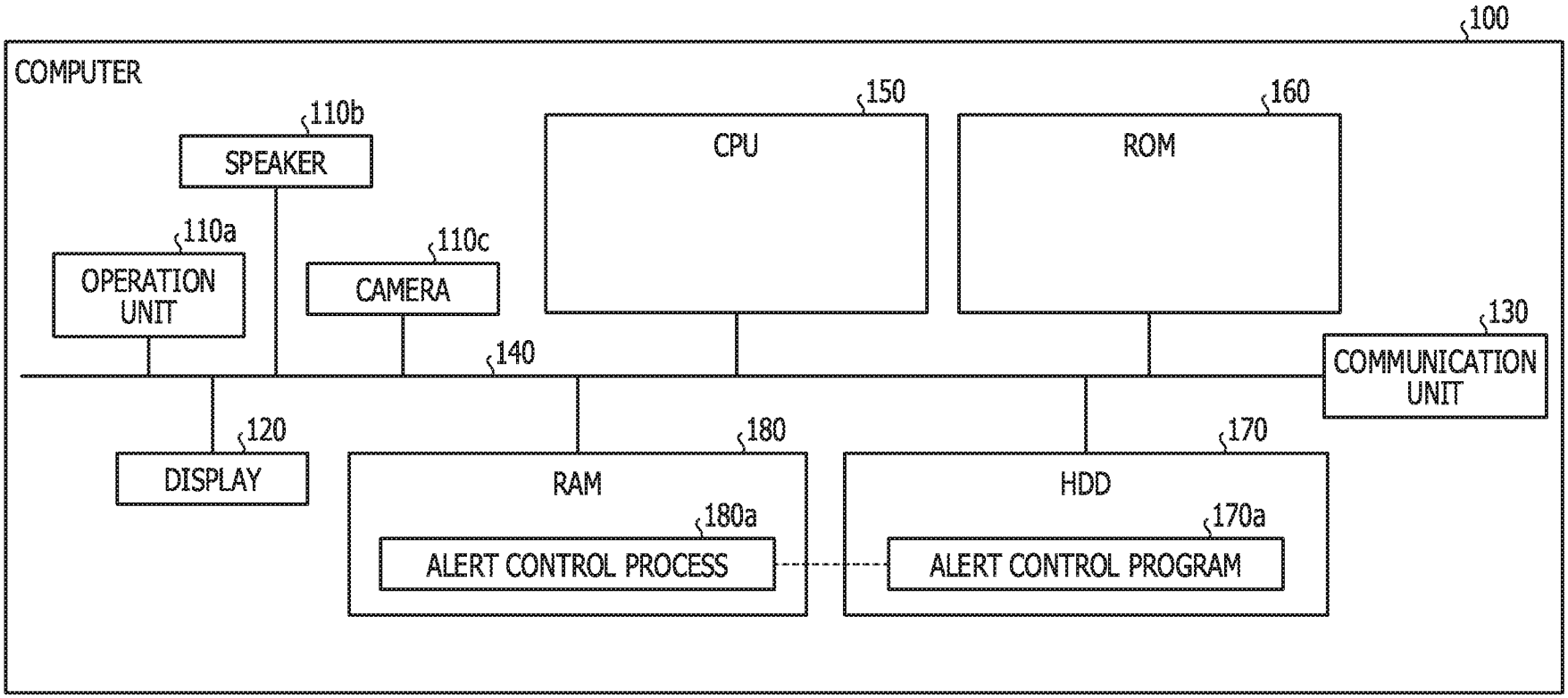
FIG. 10 is a diagram illustrating an exemplary hardware configuration of a computer configured to execute an alert control program according to Embodiments 1 and 2.

FIG. 10 is a diagram illustrating an exemplary hardware configuration of the computer configured to execute the alert control program according to Embodiments 1 and 2. As illustrated in FIG. 10, a computer 100 includes an operation unit 110*a*, a speaker 110*b*, a camera 110*c*, a display 120, and a communication unit 130. The computer 100 also includes a CPU 150, a ROM 160, a HDD 170, and a RAM 180. These components 110 to 180 are connected with each other through a bus 140.

As illustrated in FIG. 10, the HDD 170 stores an alert control program 170*a* configured to achieve a function same as that of the navigation support App execution unit 58 described above in Embodiment 1. Similarly to the components of the navigation support App execution unit 58 illustrated in FIG. 4, the alert control program 170*a* may be integrated or separated. Specifically, the HDD 170 does not necessarily have to store all data described above in Embodiment 1, but may only store data used in processing.

Under such an environment, the CPU 150 reads the alert control program 170*a* from the HDD 170 and then loads the alert control program 170*a* onto the RAM 180. As a result, as illustrated in FIG. 10, the alert control program 170*a* functions as an alert control process 180*a*. The alert control process 180*a* loads various kinds of data read from the HDD 170 onto a region allocated to the alert control process 180*a* among storage regions included in the RAM 180, and executes various kinds of processing by using the loaded various kinds of data. Examples of processing executed by the alert control process 180*a* include the processing illustrated in FIGS. 7 to 9. Not all processing units described above in Embodiment 1 necessarily have to operate on the CPU 150, but only a processing unit corresponding to processing to be executed may be virtually achieved.

The alert control program 170*a* does not necessarily have to be initially stored in the HDD 170 or the ROM 160. For example, each computer program may be stored in a "portable physical medium" such as a flexible disk (FD), a CD-ROM, a DVD disk, a magneto-optical disc, or an IC card to be inserted into the computer 100. Then, the computer 100 may acquire the computer program from the portable physical medium and execute the computer program. Alternatively, each computer program may be stored in another computer or a server device connected with the computer 100 through a public line, the Internet, a LAN, or a WAN, and the computer 100 may acquire the computer program from the other computer or the server device and execute the computer program.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An alert control system comprising:

a memory; and a processor coupled to the memory, wherein the processor is configured to:

determine whether a mode of a ship is a navigation mode indicating that the ship is in a navigation state or a mooring mode indicating that the ship is in a mooring state;

output, when determining that the mode of the ship is the navigation mode, an alert based on a first kind of alert triggers including a first alert trigger which is specific to the navigation mode and causes dangerous object determination and a second alert trigger which causes other-ship approach determination; and output, when determining that the mode of the ship is the mooring mode, an alert based on a second kind of the alert triggers including a third alert trigger which is specific to the mooring mode and the second alert trigger and causes to anchor dragging determination.

2. The alert control system according to claim 1, wherein the processor excludes, when determining that the mode of the ship is the mooring mode, as an alert to be output, an alert which is triggered by an approach to a shoal based on the first kind of the alert triggers.

3. The alert control system according to claim 1, wherein the processor excludes, when determining that the mode of the ship is the mooring mode, as an alert to be output, an alert which is triggered by approach to a reef based on the first kind of the alert triggers.

4. The alert control system according to claim 1, wherein the processor excludes, when determining that the mode of the ship is the mooring mode, as an alert to be output, an alert which is triggered by approach to a fishing net based on a the first kind of the alert triggers.

5. An alert control method comprising:

determining whether a mode of a ship is a navigation mode indicating that the ship is in a navigation state or a mooring mode indicating that the ship is in a mooring state;

outputting, when determining that the mode of the ship is the navigation mode, an alert based on a first kind of alert triggers including a first alert trigger which is specific to the navigation mode and causes dangerous object determination and a second alert trigger which causes other-ship approach determination; and outputting, when determining that the mode of the ship is the mooring mode, an alert based on a second kind of the alert triggers including a third alert trigger which is specific to the mooring mode and causes to anchor dragging determination and the second alert trigger.

6. The alert control method according to claim 5, further comprising:

excluding, when determining that the mode of the ship is the mooring mode, as an alert to be output, an alert which is triggered by an approach to a shoal based on the first kind of the alert triggers.

7. The alert control method according to claim 5, further comprising:

excluding, when determining that the mode of the ship is the mooring mode, as an alert to be output, an alert which is triggered by approach to a reef based on the first kind of the alert triggers.

8. The alert control method according to claim 5, further comprising:

excluding, when determining that the mode of the ship is the mooring mode, as an alert to be output, an alert which is triggered by approach to a fishing net based on the first kind of the alert triggers.

9. A non-transitory computer-readable recording medium storing an alert control program which causes a computer to execute a process, the process comprising:

determining whether a mode of a ship is a navigation mode indicating that the ship is in a navigation state or a mooring mode indicating that the ship is in a mooring state;

outputting, when determining that the mode of the ship is the navigation mode, an alert based on a first kind of alert triggers including a first alert trigger which is specific to the navigation mode and causes dangerous object determination and a second alert trigger which causes other-ship approach determination; and outputting, when determining that the mode of the ship is the mooring mode, an alert based on a second kind of the alert triggers including a third alert trigger which is specific to the mooring mode and causes to anchor dragging determination and the second alert trigger.

10. The non-transitory computer-readable recording medium according to claim 9, further comprising:

excluding, when determining that the mode of the ship is the mooring mode, as an alert to be output, an alert which is triggered by an approach to a shoal based on the first kind of the alert triggers.

11. The non-transitory computer-readable recording medium according to claim 9, further comprising:

excluding, when determining that the mode of the ship is the mooring mode, as an alert to be output, an alert which is triggered by approach to a reef based on the first kind of the alert triggers.

12. The non-transitory computer-readable recording medium according to claim 9, further comprising:

excluding, when determining that the mode of the ship is the mooring mode, as an alert to be output, an alert which is triggered by approach to a fishing net based on the first kind of the alert triggers.

13. The alert control system according to claim 1, wherein the alert based on the first alert trigger is output when the dangerous object determination determines that a position of an object is included in a first range which is obtained by rotating, in clockwise and anticlockwise directions, a segment which extends from a position of the ship up to a predetermined distance in a traveling direction of the ship.

14. The alert control system according to claim 1, wherein the alert based on the second alert trigger is output when the other-ship approach determination determines that a position of another ship is included in a second range of a first radius from a position of the ship.

15. The alert control system according to claim 1, wherein the alert based on the third alert trigger is output when the anchor dragging determination determines that a position of the ship deviates from a third range of a second radius based on a water depth and a length of an anchor rope from a position of the ship.

16. The alert control method according to claim 5, wherein the alert based on the first alert trigger is output when the dangerous object determination determines that a position of an object is included in a first range which is obtained by rotating, in clockwise and anticlockwise directions, a segment which extends from a position of the ship up to a predetermined distance in a traveling direction of the ship.

17. The alert control method according to claim 5, wherein the alert based on the second alert trigger is output when the other-ship approach determination determines that a position of another ship is included in a second range of a first radius from a position of the ship.

18. The alert control method according to claim 5, wherein the alert based on the third alert trigger is output when the anchor dragging determination determines that a position of the ship deviates from a third range of a second radius based on a water depth and a length of an anchor rope from a position of the ship.

19. The non-transitory computer-readable recording medium according to claim 9, wherein the alert based on the first alert trigger is output when the dangerous object determination determines that a position of an object is included in a first range which is obtained by rotating, in clockwise and anticlockwise directions, a segment which extends from a position of the ship up to a predetermined distance in a traveling direction of the ship.

20. The non-transitory computer-readable recording medium according to claim 9, wherein the alert based on the third alert trigger is output when the anchor dragging determination determines that a position of the ship deviates from a third range of a second radius based on a water depth and a length of an anchor rope from a position of the ship.

* * * * *